US005558969A

United States Patent [19]

Uyttendaele et al.

[11] Patent Number: 5,558,969

[45] Date of Patent: Sep. 24, 1996

[54] ELECTRO(STATO)GRAPHIC METHOD USING REACTIVE TONERS

[75] Inventors: Carlo Uyttendaele, Mortsel; Werner O. de Beeck, Keerbergen; Luc Leenders, Herentals; Serge Tavernier, Lint, all of Belgium

[73] Assignee: Agfa-Gevaert, N.V., Mortsel, Belgium

[21] Appl. No.: 532,501

[22] Filed: Sep. 22, 1995

[30] Foreign Application Priority Data

Oct. 3, 1994 [EP] European Pat. Off. ..... 94202848

[51] Int. Cl.[6] ..... G03G 13/20

[52] U.S. Cl. ..... 430/124; 346/153.1; 342/55; 342/158

[58] Field of Search ..... 430/124; 427/384; 346/153.1

[56] References Cited

U.S. PATENT DOCUMENTS 4,082,879 4/1978 Conder et al. ..... 428/219

4,987,063 1/1991 Kampter et al. ..... 430/550

*Primary Examiner*—John Goodrow

*Attorney, Agent, or Firm*—Breiner & Breiner

[57] ABSTRACT

An electro(stato)graphic method is provided, comprising the steps of image wise applying toner particles to a final substrate and fixing the toner particles on a final non-photoconductive substrate, characterized in that (i) the toner particles comprise at least one substantially light insensitive silver salt (compound B) and at least one reductant (compound A), so as to be capable, upon reaction of compound A and B, of forming a light absorbing substance in said final substrate, (ii) the toner particles optionally comprise a light absorbing pigment or dye (iii) the light absorbing substance can give a maximum density ($D_{max}$)>2.00 either on itself or in combination with said light absorbing pigment or dye and (iv) the toner particles are fixed on to the final substrate by heat or by heat and pressure.

24 Claims, No Drawings

ELECTRO(STATO)GRAPHIC METHOD USING REACTIVE TONERS

DESCRIPTION

1. Field of the Invention

The present invention relates to an electro(stato)graphic process. It relates especially to an electrographic process for making transparent images with high (>2.00) maximum transmission density.

2. Background of the Invention

In electrostatography two main methods of producing images by fixing light absorbing particles (called toner particles) to a substrate are known: Direct Electrostatic Printing (DEP) and classical electro(stato)graphy.

In DEP (Direct Electrostatic Printing) the toner or developing material is deposited directly in an imagewise way on a substrate, the latter not bearing any imagewise latent electrostatic image. The substrate can be an intermediate, in case it is preferred to transfer said formed image on another substrate (e.g. aluminum, etc.), but it is preferentially the final receptor, thus offering a possibility to create directly the image on the final receptor, e.g. plain paper, transparency, etc. . . . after a final fusing step. DEP devices are disclosed in e.g. U.S. Pat. No. 3,689,935, GB-P 2,108,432, DE-OS 3,411,948, EP-A 266 960, U.S. Pat. No. 4,743,926, EP-B 390 847 etc.

In classical (regular) electrostatography a latent electrostatic image on a charge retentive surface is developed by a suitable material to make the latent image visible and in which either the powder image is fused directly to said charge rententive surface, which then results in a direct electrographic print, or in which the powder image is subsequently transferred to the final substrate and then fused to that medium, the latter proces resulting in a indirect electrographic print. The suitable material to develop the latent electrostatic image are light absorbing particles, called toner particles, which usually are triboelectrically charged. The toner particles comprise mostly a pigment or dye. A black toner comprises mostly carbon black as the pigment. Several useful pigments for preparation of colored toners are well known in the art.

In toner development of latent electrostatic images two techniques have been applied: "dry" powder and "liquid" dispersion development of which dry powder development is nowadays most frequently used. In most cases the latent image is developed with a finely divided developing material or toner to form a powder image which is then transferred onto a support sheet.

The transferred image may subsequently be permanently affixed to the substrate by heat, pressure, or a combination of heat and pressure.

When the developed image is transferred to a transparent support, be it by a DEP process or by classical (regular) electro(stato)graphy, the obtainable maximum transmission density is around 2.00. This is due to the definite size of the toner particles, the limited amount of pigment that can be incorporated in toner particles without negatively influencing the quality of the toner particles and to the finite amount of toner particles that can be deposited on the electrostatic latent image. The amount of toner particles that can be deposited in classical electro(photo)graphy is typically between 5 g/m$^2$ to 10 g/m$^2$. This transmission density level is acceptable in e.g. transparencies for overhead projection, but is not satisfactory for the production of masks that are used in graphic applications. Typical example of masks that are used in graphic applications, are the masks used in e.g. the production of microelectronic integrated circuits or printed circuit boards (PCB). In the procuction of PCB's, a photosenstive composition on a PCB precursor is exposed through a mask to produce a PCB. An example of the production of a PCB can be found in in FR 2,589,593. The advantage of the electrographic preparation of masks for PCB production is the absence of solvents during manufacture and the fact that on the mask no hydrophilic layer, prone to dimensional changes as a function of RH (relative humidity), is necessary. So a dimensionally stable mask can be prepared.

Various ways and means have been disclosed to enhance the obtainable maximum transmission density of the developed image transferred to a transparent support. When the dimensions of the pigmented toner particles become smaller, the obtainable transmission density is enhanced. Examples of toner compositions comprising small particles with a narrow size distribution are disclosed in e.g. U.S. Pat. No. 4,748,474; U.S. Pat. No. 4,737,433; U.S. Pat. No. 4,434,220; U.S. Pat. No. 4,822,060 and WO A1 91/00548.

When it is possible to use lower charge toner particles, it is possible to deposit more toner particles on the latent image for a given charge of said latent image. Examples of low charge toners are disclosed in e.g. European Application 93201351.9 filed on May 11, 1993, European Application 93201352.7 filed on May 11, 1993 and European Application 93201644.7 filed on Jun. 9, 1993.

In European Application 93201647.0 filed on Jun. 9, 1993 it is disclosed to enhance the obtainable transmission density by better dividing the pigment in the toner particles.

All these measures do help to increase the obtainable maximum transmission density, but it remains difficult to reach a maximum transmission density over 2.00. The minimum requirement on maximum transmission density for masks that are used in graphic applications is 3.00, the desired maximum transmission density being 4.00.

In DE-A 42 41 611 it is disclosed to combine electrophotography and diazotype printing to produce a high density transparency. This proces yields satisfactory high density, but there remains still a development step using $NH_3$ either as a gas or as aqueous solution. Since the urge to provide for "office friendly" printing processes grows, the process described in DE-A 42 41 611 is less satifactory.

There is thus still room for an electrographic system that makes it possible to prepare images on transparent supports with a maximum transmission density equal to or higher than 2.00.

In electro(photo)graphic printing processes using a reflecting final substrate it is possible to obtain sufficiently high maximum black densities (about 2.00) when using e.g. carbon black as a pigment incorporated in the toner particles and depositing between 5 g/m$^2$ and 10 g/m$^2$ of toner particles. However, even for prints made on reflecting supports, higher maximum densities are desirable. Moreover, when larger surfaces of maximum density are present, some micro-voiding exists. This micro-voiding (low density micro-spots within a surface of maximumm density) deteriorates the quality of the print. In electro(photo)graphic processes using a transparent substrate this micro-voiding deteriorates even more the quality of the print. There is thus also a need to have an electro(photo)graphic process that avoids this micro-voiding.

3. Objects and Summary of the Invention

It is an object of the present invention to provide an electro(stato)graphic method that makes it possible to prepare transparencies with a maximum transmission density equal to or higher than 2.00.

It is an other object of the present invention to provide an electro(stato)graphic method that makes it possible to prepare images without micro-voiding.

It is a further object to provide electro(stato)graphic method that makes it possible to prepare images without micro-voiding on an opaque reflecting support with a reflection maximum density higher than 2.00.

It is an other object of the invention to provide an electrographic system comprising the step of toner transfer from the developed latent electrographic image onto a final non-photoconductive substrate, whereon the toner is fixed in an heat fixing step.

Further objects and advantages of the invention will become clear from the description hereinafter.

In the text herinafter "maximum density" is used to mean both "maximum transmission density" and "maximum reflection density" depending on the type (transparent or opaque and reflecting) of final substrate that is used.

The objects of the invention are realized by providing an electro(stato)graphic method comprising the steps of image wise applying toner particles to a final non-photoconductive substrate and fixing said toner particles on said final substrate, characterised in that (i) said toner particles comprise at least one reductant (compound A) and said final substrate comprises at least one substantially light insensitive silver salt (compound B) or vice versa, so as to be capable, upon reaction of compound A and B, of forming a light absorbing substance in said final substrate, (ii) said toner particles optionally comprise a light absorbing pigment or dye, (iii) said light absorbing substance can give a maximum density ($D_{max}$)>2.00 either on itself or in combination with said light absorbing pigment or dye and (iv) said toner particles are fixed on to the final substrate by heat or by heat and pressure.

In a further preferred embodiment said reductant (compound A) is incorporated in said toner particles and said substantially light insensitive silver salt (compound B) is incorporated in said final substrate.

In a further preferred embodiment the reaction between reductant (compound A) and substantially light insensitive silver salt (compound B) is aided by an auxiliary reductant C.

In a most preferred embodiment, said substantially light insensitive silver salt is a silver salt of a fatty acid, wherein the aliphatic carbon chain has preferably at least 12 C-atoms and said reductant is a di- or tri-hydroxy compound.

4. Detailed Description of the Invention

Electrostatographic methods using reactive toners are well known in the art. Examples of couples reactive toner/reactive receptor can be found in, e.g., GB 898,354, U.S. Pat. No. 3,080,251, U.S. Pat. No. 3,253,913, JP 64/11541 etc. In all these disclosures, however, the reactive receptor for the toner particles is a photoconductive member (mainly) based on ZnO, and the toner particles are not further transferred from said photoconductive member to a final non-photoconductive substrate.

In U.S. Pat. No. 3,386,379 and U.S. Pat. No. 3,508,823 it is disclosed to use a reactive toner from which, upon heating a reactant evaporates. The object of the referenced disclosures is to provide an electrophotographic method that enables to make multiple copies after a single photographic exposure. In order to realize this object, the toner particles are not transferred to said final substrate, but stay on a photoconductive member and are brought in contact with a final substrate. The photoconductive member is then heated and the reactant contained in the toner evaporates partially and reacts with the reactant in the final substrate. This cycle is -repeated with a new sheet of final substrate until the toner particles are exhausted. Then the photoconductive member is cleaned, exposed again and the cycle is restarted.

Since in this method the toner stays attached to the photoconductive member and is heated while attached to said photoconductive member, the toner particles are not only releasing the reactant contained in them, but are also, to a more or lesser degree molten on the photoconductive member. The molten toner particles stick to the photoconductive member and can no longer be cleaned away after the exhaustion from reactant and thus deteriorate the surface of said photoconductive member.

It has been found that it is possible to produce reactive toner particles, comprising one or more reactants, that can develop a latent electrostatographic image on an intermediate charge retentive surface and that can be transferred to a final non-photoconductive substrate. In the final non-photoconductive substrate a second reagent is present (when the toner particles comprise only one reagent) and the toner particles, comprising a first reagent, are fixed by heat or by the combination of heat and pressure. During the fixing step the reagents comprised in the toner particles and in the final substrate react together to form a light absorbing substance. When the toner particles comprise at least two reagents, these two reactants react together during the fixing step to form a light absorbing substance.

In the method according to the invention, the charge retentive surface is not deteriorated by toner particles sticking to it, and can be reused again and again.

In the prior art disclosure various couples of reagents, forming light absorbing substances, have been disclosed for use in electrostatographic methods using a reactive toner and a reactive substrate. Dye forming couples have be disclosed in e.g. WO 89/09433, where toners containing dye precursors optionally together with a developer are described. In U.S. Pat. No. 4,054,712 it is disclosed to use a toner containing a reagent and a substrate containing another reagent, whereby upon fixing of the toner particles both reagents together form a dye. The use of leuco dyes has been described in EP-A 026 096.

It has been found however that in an electrostatographic method according to the present invention using a reactive toner and a final substrate, the best results have been reached by using a reductant, preferably an organic reductant (compound A), (optionally aided by an auxiliary reductant (compound C)) and a substantially light insensitive silver salt (compound B).

The substantially light insensitive silver salt (compound B).

Substantially light insensitive organic silver salts particularly suited for use according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, and likewise silver dodecyl sulphonate described in U.S. Pat. No. 4,504,575 and silver di-(2-ethylhexyl)-sulfosuccinate described in published EP-A 227 141. Useful modified aliphatic carboxylic acids with thioether group are described e.g. in GB-P 1,111,492 and other organic silver salts are described in GB-P 1,439,478, e.g. silver benzoate and silver phthalazinone, which may be used likewise to produce a thermally developable silver image. Further are mentioned silver imidazolates and the substantially light-insensitive inorganic or organic silver salt complexes described in U.S. Pat. No. 4,260,677. For use according to the present invention silverstearate and silverbehenate are the preferred substantially light insensitive silversalts. It is most preferred to use silverbehenate in the method according to the present invention.

The organic reductant (compound A) and the auxiliary reductant (compound C)

Suitable organic reductants (reducing agents) for the reduction of said substantially light-unsensitive organic silver salts are organic compounds containing at least one active hydrogen atom linked to O, N or C, such as is the case in aromatic di- and trihydroxy compounds, e.g. hydroquinone and substituted hydroquinones, catechol, pyrogallol, gallic acid and gallates; aminophenols, METOL (tradename) , p-phenylenediamines, alkoxynaphthols, e.g. 4-methoxy-1-naphthol described in U.S. Pat. No. 3,094,417, acetoacetonitriles, pyrazolidin-3-one type reducing agents, e.g. PHENIDONE (tradename), pyrazolin-5-ones, indanedione-1,3 derivatives, hydroxytetrone acids, hydroxytetronimides, reductones, and ascorbic acid. Representatives for thermally activated reduction of substantially light insensitive silver salts are described e.g. in U.S. Pat. No. 3,074,809, 3,080,254, 3,094,417, 3,887,378 and 4,082,901.

Particularly suited organic reducing agents for use in thermally activated reduction of said substantially light insenstive silver salts are catechol-type reducing agents, by which is meant reducing agents containing at least one benzene nucleus with two hydroxy groups (—OH) in ortho-position, e.g. , catechol, 3- (3,4-dihydroxyphenyl) propionic acid, 1,2-dihydroxybezoic acid, methyl gallate, ethyl gallate, propyl gallate, tannic acid and 3,4-dihydroxy-benzoic acid esters. Preferred reductants are gallic acid or derivative thereof.

The reductant to be used in an electrostatographic method according to the present invention, can in fact be a mixture of (a) primary, relatively strong reducing agent (compound A), as described above and (b) a less active auxiliary reducing agent (compound C) that form together a synergistic (superadditive) reducing mixture. As less active auxiliary reducing agents (compound C) preferably sterically hindered phenols are used. Sterically hindered phenols as described e.g. in U.S. Pat. No. 4,001,026 are examples of such auxiliary reducing agents.

It is preferred that the amount of reducing agents (i.e. the sum of the amount of compound A and of compound C) is at least equivalent to the amount of substantially light insensitive silver salt, i.e. there is preferably at least enough reducing agent present to reduce all substantially light insenstive silver salt present. When the equivalent amount of reducing agents is a mixture of compound A and compound C it is preferred that compound A (the strong reducing agent) is present for 4 to 40% (in equivalent amount with respect to the total amount of substantially light insensitive silver salt) the remainder being compound C (the auxiliary reducing agent).

Toning agents (compound D)

It is possible that the light absorbing product formed by reaction of compounds A and B does not give a neutral black image tone in the higher densities nor a neutral grey image tone in the lower densities. Therefore toning agents, known from thermography or photo-thermography may be added in the process. Said toning agents can be incorporated in the toner particles or in the final image receiving substrate.

Suitable toning agents, for use in a method according to the present invention, are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toning compounds of the benzoxazine dione or naphthoxazine dione type within the scope of following general formula:

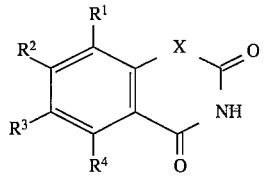

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring. Toning compounds within the scope of said general formula are described in GB-P 1,439,478 and U.S. Pat. No. 3,951,660.

A toning compound particularly suited for use in combination with polyhydroxy benzene reducing agents is 3,4-dihydro-2,4-dioxo -1,3,2H-benzoxazine described in U.S. Pat. No. 3,951,660.

The toner particles

The toner particles for use in a method according to the present invention can essentially be of any nature as well with respect to their composition, shape, size, and preparation method and the sign of their tribo-electrically acquired charge, as long as said toner particles comprise at least one of the compounds A, B or C.

The toner particles used in accordance with the present invention may comprise any conventional resin binder. The binder resins used for producing toner particles according to the present invention may be addition polymers e.g. polystyrene or homologues, styrene/acrylic copolymers, styrene/methacrylate copolymers, styrene/acrylate/acrylonitile copolymers or mixtures thereof. Addition polymers suitable for the use as a binder resin in the production of toner particles according to the present invention are disclosed e.g. in BE 61,855/70, DE 2,352,604, DE 2,506,086, U.S. Pat. No. 3,740,334.

Also polycondensation polymers may be used in the production of toner particles according to the present invention. Polyesters prepared by reacting organic carboxylic acids (di or tricarboxylic acids) with polyols (di- or triol) are the most prefered polycondensation polymers. The carboxylic acid may be e.g. maleic acid, fumaric acid, phthalic acid, isophthalic acid, terephthalic acid, trimellitic acid, etc or mixtures thereof. The polyolcomponent may be ethyleneglycol, diethylene glycol, polyethylene glycol, a bisphenol such as 2,2-bis(4-hydroxyphenyl)-propane called "bisphenol A" or an alkoxylated bisphenol, a trihydroxy alcohol, etc or mixtures thereof. Polyesters, suitable for use in the preparation of toner particles according to the present invention are disclosed in e.g. U.S. Pat. No. 3,590,000, U.S. Pat.

No. 3,681,106, U.S. Pat. No. 4,525,445, U.S. Pat. No. 4,657,837, U.S. Pat. No. 5,153,301.

It is also possible to use a blend of addition polymers and polycondensation polymers in the preparation of toner particles according to the present invention as disclosed e.g. in U.S. Pat. No. 4,271,249.

In order to modify or improve the triboelectric chargeability in either negative or positive direction the toner particles may contain (a) charge control agent(s). For example, in published German patent application DE-OS 3,022,333 charge control agents for yielding negatively chargeable toners are described. In DE-OS 2,362,410 and U.S. Pat. Nos. 4,263,389 and 4,264,702 charge control agents for positive chargeability are described. Very useful charge controlling agents for providing a net positive charge to the toner particles are described in U.S. Pat. No. 4,525,445, more particularly BONTRON NO4 (trade name of Oriental Chemical Industries—Japan) being a nigrosine dye base neutralized with acid to form a nigrosine salt, which is used e.g. in an amount up to 5% by weight with respect to the toner particle composition. A very suitable charge control agent for use in toner particles according to the present invention, is zinc benzoate and reference therefor is made to published EP-A 463 876 decribing zinc benzoate compounds as charge controlling agents. Such charge controlling agent may be present in an amount up to 5% by weight with respect to the toner particle composition.

The toner particles for use according to the present invention can also comprise one or more pigments either to increase the achievable maximum density or to improve the tone of the image formed by the reaction of compounds A and B. As black pigment carbon black is preferred, and as tone modifying pigments any of the pigments (or mixture of pigments) known in the art of color toner production can be used and the amount adapted to the desired tone modification.

The toner particles for use in a method according to the present invention may comprise also toning agents (compound D), as described above, in order to obtain a neutral black image tone in the higher densities and neutral grey in the lower densities.

The toner particles for use in a method according to the present invention may comprise infrared absorbers (e.g. carbon black or organic infrared absorbing compounds, both IR absorbing organic pigments and IR absorbing organic dyes) to facilitate the use of said toners in apparatus using IR (infrared) radiation to heat-fix said toners (examples of such IR elements for heat-fixing toners can be found in, e.g., in the text of Example 8 of U.S. Pat. No. Patent 4,525,445. Examples of carbon black are lamp black, channel black and furnace black e.g. SPEZIALSCHWARZ IV (trade name of Degussa Frankfurt/M—Germany) and VULCAN XC 72 and CABOT REGAL 400 (trade names of Cabot Corp. High Street 125, Boston, U.S.A.). Examples of suitable organic IR absorbing dyes for use in toner particles according to the present invention are a.o a mixture of 3 parts of

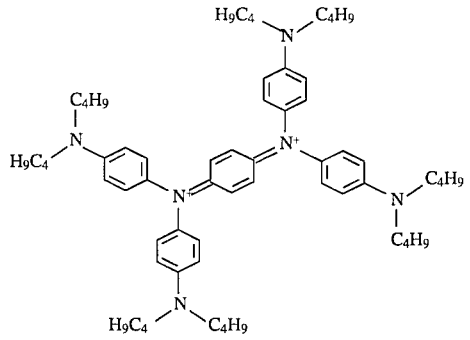

and 2 parts of

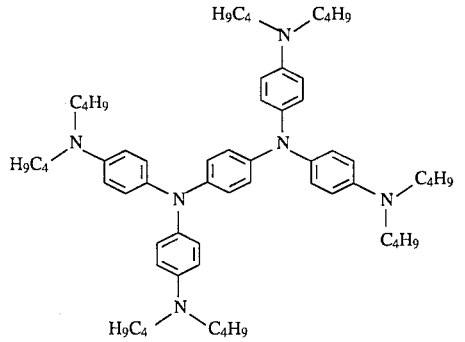

The toner particles may also comprise waxes or "heat solvents" also called "thermal solvents" or "thermosolvents" improving the penetration of the reducing agent(s) and thereby the reaction speed of the redox-reaction at elevated temperature.

By the term "heat solvent" in this invention is meant a non-hydrolyzable organic material which is in solid state at temperatures below 50° C. but becomes on heating above that temperature a plasticizer for the binder of the layer wherein they are incorporated and possibly act then also as a solvent for at least one of the redox-reactants, e.g. the reducing agent for the substantially light insensitive silver salt. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1, 1-dioxide, methyl anisate and 1,10-decanediol being described as heat solvents in Research Disclosure, December 1976, (item 15027) pages 26–28. Still other examples of heat solvents have been described in U.S. Pat. No. 3,438,776, and 4,740,446, and in published EP-A 0 119 615 and 0 122 512 and DE-A 3 339 810.

The toner powder particles according to the present invention may be prepared by mixing the above defined binder resin(s) and ingredients (e.g. an inorganic filler, a charge controlling agent, at least one of the compounds A, B or C, etc) in the melt phase, e.g. using a kneader. The kneaded mass has preferably a temperature in the range of 90° to 140° C., and more preferably in the range of 105° to 120° C. After cooling the solidified mass is crushed, e.g. in a hammer mill and the obtained coarse particles further broken e.g. by a jet mill to obtain sufficiently .small particles from which a desired fraction can be separated by sieving, wind classification, cyclone separation or other classifying technique. The actually used toner particles have preferably an average diameter between 3 and 20 μm on volume, more preferably between 5 and 10 μm when measured with a COULTER COUNTER (registered trade mark) MULTIZISER particle size analyzer operating according to the principles of electrolyt displacement in narrow aperture and marketed by COULTER ELECTRONICS Corp. Northwell Drive, Luton, Bedfordshire, LC 33, UK. In said apparatus particles suspended in an electrolyte (e.g. aqueous sodium chloride) are forced through a small aperture, across which an electric current path has been established. The particles passing one-by-one each displace electrolyte in the aperture producing a pulse equal the displaced volume of electrolyte. Thus particle volume response is the basis for said measurement.

Suitable milling and air classification may be obtained when employing a combination apparatus such as the Alpine Fliessbeth-Gegenstrahlmühle (A.F.G.) type 100 as milling means and the Alpine Turboplex Windsichter (A.T.P.) type 50 G.C as air classification means, available from Alpine Process Technology, Ltd., Rivington Road, Whitehouse, Industrial Estate, Runcorn, Cheshire, UK. Another useful apparatus for said purpose is the Alpine Multiplex Zick-Zack Sichter also available from the last mentioned company.

The toner particles according to the present invention may also be prepared by a "polymer suspension" process. In this process the toner resin (polymer) is dissolved in a water immiscible solvent with low boiling point and the toner ingredients (e.g. an inorganic filler, a charge controlling agent, at least one of the compounds A, B or C, etc) are dispersed in that solution. The resulting solution/dispersion is dispersed/suspended in an aqueous medium that contains a stabilizer. The organic solvent is evaporated and the resulting particles are dried. The evaporation of the solvent can proceed by increasing temperature, by vacuum evapoartion, by spray-drying as described in, e.g. U.S. Pat. No. 3,166,510, U.S. Pat. No. 3,338,991, electrostatic pulverizing as described in, e.g. GB 2,121,203, etc. As suspension stabilizer it is possible to use e.g. silica particles, water soluble organic protective colloids (e.g. polyvinylalcohol), surface active agents, etc. In this procedure the temperature of the toner preparation can be lower than in the melt kneading toner preparation process.

In order to improve the flowability of the toner particles spacing particles may be added externally to said toner particles.

Said spacing particles may be embedded in the surface of the toner particles or protruding therefrom or may be externally mixed with the toner particles, i.e. are used in admixture with the bulk of toner particles after the toner particles are produced. These flow improving additives are preferably extremely finely divided inorganic or organic materials the primary (i.e. non-clustered) particle size of which is less than 50 nm; essentially the same inorganic materials as those used in the preparation step of the toner particles are preferred, but the particles are preferentially hydrophobic. Silica particles that have been made hydrophobic by treatment with organic fluorine compounds for use in combination with toner particles are described in published EP-A 467439.

In preferred embodiments the proportions for fumed metal oxides such as silica ($SiO_2$) and alumina ($Al_2O_3$) to be admixed externally to the toner particles, prepared according to the present invention, are in the range of 0.1 to 10% by weight in respect to the toner particles.

Fumed silica particles are commercially available under the tradenames AEROSIL and CAB-O-Sil being trade names of Degussa, Franfurt/M Germany and Cabot Corp. Oxides Division, Boston, Mass., U.S.A. respectively. For example, AEROSIL R972 (tradename) is used which is a fumed hydrophobic silica having a specific surface area of 110 $m^2/g$. The specific surface area can be measured by a method described by Nelsen and Eggertsen in "Determination of Surface Area Adsorption measurements by continuous Flow Method", Analytical Chemistry, Vol. 30, No. 9 (1958) p. 1387–1390.

In addition to the fumed metal oxide, a metal soap e.g. zinc stearate, as described in GB-P 1,379,252, wherein also reference is made to the use of fluor containing polymer particles of sub-micron size as flow improving agents, may be present in the developer composition comprising the toner particles according to the present invention.

The powder toner particles according to the present invention may be used as mono-component developer, i.e. in the absense of carrier particles but are preferably used in a two-component system comprising carrier particles.

When used in admixture with carrier particles, 2 to 10% by weight of toner particles is present in the whole developer composition. Proper mixing with the carrier particles may be obtained in a tumble mixer.

Suitable carrier particles for use in cascade or magnetic brush development are described e.g. in GB-P 1,438,110. For magnetic brush development the carrier particles may be on the basis of ferromagnetic material e.g. steel, nickel, iron beads, ferrites and the like or mixtures thereof. The ferromagnetic particles may be coated with a resinous envelope or are present in a resin binder mass as described e.g. in U.S. Pat. No. 4,600,675. The average particle size of the carrier particles is preferably in the range of 20 to 300 μm and more preferably in the range of 30 to 100 μm.

In a particularly interesting embodiment iron carrier beads of a diameter in the range of 50 to 200 μm coated with a thin skin of iron oxide are used. Carrier particles with spherical shape can be prepared according to a process described in United Kingdom Patent Specification 1,174,571.

In the process according to the present invention, the toner particles are deposited on the final substrate in an amount between 5 $g/m^2$ and 10 $g/m^2$. The amount is preferably between 6 and 7 $g/m^2$.

The toner particles can not only be used in a regular electrostatographic process, but also be used in a DEP (Direct Electrostatic Printing) method.

When together with either compound A, B or C or mixtures of these compounds, magnetic particles are added to the toner particles, the toner particles can be used in magnetographic printing processes.

The final non-photoconductive substrate

The final non-photoconductive substrate may be opaque and reflecting or transparent. In a preferred embodiment the final substrate is transparent.

A transparent final substrate comprises a toner receiving layer coated on a transparent support. Said toner receiving layer comprises, apart from compounds A, B or C, or mixtures thereof and optionally toning agents (compound D), also a binding agent or mixture of binding agents. As binding agent (binder) preferably thermoplastic water insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α, β-ethylenically unsaturated compounds such as styrene, polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral. Polyvinyl butyral containing some vinyl alcohol units is marketed under the trade name BUTVAR B79 of Monsanto USA.

The above mentioned polymers or mixtures thereof forming the binder may be used in conjunction with waxes or "heat solvents" also called "thermal solvents" or "thermo-solvents" improving the penetration of the reducing agent(s) and thereby the reaction speed of the redox-reaction at elevated temperature.

By the term "heat solvent" in this invention is meant a non-hydrolyzable organic material which is in solid state at temperatures below 50° C. but becomes on heating above that temperature a plasticizer for the binder of the layer wherein they are incorporated and possibly act then also as a solvent for at least one of the redox-reactants, e.g. the reducing agent for the substantially light insensitive silver salt. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1, 1-dioxide, methyl anisate and 1,10-decanediol being described as heat solvents in Research Disclosure, December 1976, (item 15027) pages 26–28. Still other examples of heat solvents have been described in U.S. Pat. No. 3,438,776, and 4,740,446, and in published EP-A 0 119 615 and 0 122 512 and DE-A 3 339 810.

Said toner receiving layer may comprise, apart from compounds A, B or C, or mixtures thereof and a binding agent or mixture of binding agents, also stabilizers, toning agents, antistatic agents, spacing particles (both polymeric or anorganic).

In addition to said ingredients the imaging layer may contain other additives such as free fatty acids, antistatic agents, e.g. non-ionic antistatic agents including a fluorocarbon group as e.g. in $F_3C(CF_2)_6CONH(CH_2CH_2O)$-H, ultraviolet light absorbing compounds, white light reflecting and/or ultraviolet radiation reflecting pigments, and/or optical brightening agents.

The transparent support is preferably a polymeric support. A wide variety of such supports are known and are commonly employed in the art. They include, for example, transparent supports as those used in the manufacture of photographic films including cellulose acetate propionate or cellulose acetate butyrate, polyesters such as poly(ethyleneterephthalate), poly(ethylenenaphthalate), polyamides, polycarbonates, polyimides, polyolefins, poly(vinylacetals), polyethers and polysulfonamides. Polyester film supports and especially poly(ethyleneterephthalate) and poly(ethylenenaphthalate) are preferred because of their excellent properties of dimensional stability.

When the final substrate is opaque and reflecting, it may be paper, polyethylene coated paper, an opaque polymeric reflecting substate, etc. Opaque reflecting polymeric substrates, useful as a final substrate to be used according to this invention, are e.g. polyethyleneterephthalate films comprising a white pigment, as described in e.g. U.S. Pat. No. 4,780,402, EP-B 182 253. Preferred however are polyethyleneterephthalate films comprising discrete particles of a homopolymer or copolymer of ethylene or propylene as described in e.g. U.S. Pat. No. 4,187,113. Most preferred are opaque reflecting final substrates comprising a multi-ply film wherein one layer of said—multi ply film is a polyethyleneterephthalate film comprising discrete particles of a homopolymer or copolymer of ethylene or propylene and at least one other layer is a polyethyleneterphthalate film comprising a white pigment as described in e.g. European application 92202460.9 filed Aug. 11, 1992 and Japanese non examined application JN 63/200147.

When the opaque reflecting final substrate is either polyetylene coated paper or an opaque reflecting polymeric substrate, a toner receiving layer as described above is coated onto said substrate.

The electrostatographic method according to the present invention is workable in electrostatographic systems, wherein a latent electrostatic image is formed on a charge retentive surface and this latent image is developed by toner particles and then the toner particles are transferred to a final substrate. The latent electrostatic image on the charge retentive surface can be formed by imagewise jetting of ions on the charge retentive surface, or by electrophotography, where a photoconductive charge retentive surface is uniformely charged and then imagewise decharged under influence of light. It is also workable in DEP (Direct Electrostatic Printing) systems wherein the toner or developing material is deposited directly in an imagewise way on a substrate, the latter not bearing any imagewise latent electrostatic image.

The electrostatographic method according to the present invention can be implemented via several modes of operation:

In a first mode of operation the reductant (compound A) is incorporated in the toner particles and the substantially light insensitive silversalt (compound B) is incorporated in the final transparent substrate. In a variant of this first mode of operation an auxiliary reductant (compound C) is also incorporated in the final transparent substrate.

In a second mode of operation the reductant (compound A) is incorporated in the final transparent substrate and the substantially light insensitive silver salt (compound B) is incorporated in the toner particles. This second mode of operation has the advantage that the final substrate is more stable against influences of light and/or heat than the final substrate according to the first mode of operation.

In a third mode of operation both compound A and B (reductant and substantially light insensitive silver salt) are incorporated in the toner particles. In this case the final substrate does not need to comprise reagents (can be any transparent substrate known in the art of electrostatography), although it is preferred to incorporate an auxiliary reductant (compound C) in the final substrate.

In a fourth mode of operation two different toners are prepared one comprising a reductant (compound A) and one comprising a substantially light insensitive silver salt (compound B). Either one or each of the toners can further comprise an auxiliary reductant (compound C). In this mode of operation, the electrographic apparatus comprises two toning stations to bring both toners in register on top of or adjacent to each other onto the final substrate. This can be done by any electro(photo-)graphic system known in the art and designed to bring toner images in register on top of each other.

The enumerated modes of operation do not restrict the scope of the invention to those specific mode of operations, other combinations of the location of the reactants (compounds A, B and C) are imaginable.

In the first mode of operation, where the substantially light insensitive silver salt is incorporated in a binder layer coated on the final transparent substrate, the coverage of the silver salt in said final substrate is preferably in the range of 1 $g/m^2$ to 10 $g/m^2$.

Apart from the silver salt, the binder layer coated on said final substrate, according to this first mode of operation of the invention, may also contain an auxiliary reducing agent (compound C) having poor reducing power in the binder layer containing the substantially light insensitive silver salt. Compound C can be combined with the substantially light insensitive silver salt without causing fog when no primary reducing agent (compound A) is present.

As auxiliary reductants (compound C) sterically hindered phenols are preferably used. Sterically hindered phenols as described e.g. in U.S. Pat. No. 4,001,026 are examples of such auxiliary reducing agents that can be used in admixture with said substantially light insensitive silver salts without premature reduction reaction and fog-formation at room temperature.

The binder layer coated on the final substrate may also contain toning agent(s) (compound D) as described above.

The binder to substantially light insensitive silver salt weight ratio is preferably in the range of 0.2 to 6, and the thickness of the image forming layer is preferably in the range of 5 to 20 μm.

In this first mode of operation of the present invention, a reductant (compound A) is comprised into the toner particles. This reductant is present in the toner particles between 0.5 and 15% in weight (w/w) with respect to the total weight of the toner ingredients (toner resin included). The toner particles comprising compound A, may be prepared as well by a melt-kneading procedure as by a "polymer suspension" procedure as disclosed above.

In the second mode of operation of the present invention, where the reductant (compound A) is incorporated in the final transparent substrate and the substantially light insensitive silver salt (compound B) is incorporated in the toner particles, the toner receiving layer on the final substrate comprises between 0.2 to 5 $g/m^2$ of an organic reductant, preferably between 1 and 3 $g/m^2$. The ratio reductant to binder is comprised between 0.1 and 6 and the thickness of the layer is comprised between 2 and 20 μm. Optionally the toner receiving layer comprises also an auxiliary reductant (compound C).

The toner particles, comprising compound B, can be prepared by a melt kneading process for mixing toner ingredients and toner resins. When using a melt kneading toner preparation technique, it is preferred to use a toner resin being able to be melt kneaded at a temperature under 90° C. It is preferred to prepare the toner particles for use according to the second mode of operation of the present invention by a "polymer suspension" process. In this process the resin is dissolved in a water immiscible solvent with low boiling point and the toner ingredients (e.g. an inorganic filler, a charge controlling agent, at least one of the compounds A, B or C, etc) are dispersed in that solution. The resulting solution/dispersion is dispersed in an aqueous medium that contains a stabilizer, the organic solvent is evaporated and and the resulting particles are dried. As suspension stabilizer it is possible to use e.g. silica particles, water soluble organic protective colloids (e.g. polyvinylalcohol), surface active agents, etc. In this procedure the temperature of the toner preparation can be lower than in the melt kneeding toner preparation process.

The toner particles, for use according to the second mode of operation of the present invention, comprise between 5 and 20% of compound B by weight (% w/w) with respect to the total weight of the toner ingredients (toner resins included).

In the third mode of operation, the final transparent substrate does not comprise any reactant, except for an optional auxiliary reductant. Both main reactants, compound A and B are incorporated in the toner particles. In this case it is possible to prepare the toner particles by an melt kneading process for mixing toner ingredients and toner resins. When using a melt kneading toner preparation technique, it is necessary to use a toner resin being able to be melt kneaded at a temperature under 90° C. This necessity restricts heavily the choice of toner resins that are employable.

The toner particles for use according to the third mode of operation of the present invention may be prepared by a "polymer suspension" process. In this process the resin is dissolved in a water immiscible solvent with low boiling point and the toner ingredients (e.g. an inorganic filler, a charge controlling agent, at least one of the compounds A, B or C, etc) are dispersed in that solution. The resulting solution/dispersion is dispersed in an aqueous medium that contains a stabilizer, the organic solvent is evaporated and and the resulting particles are dried. As suspension stabilizer it is possible to use e.g. silica particles, water soluble organic protective colloids (e.g. polyvinylalcohol), surface active agents, etc. In this procedure the temperature of the toner preparation can be lower than in the melt kneeding toner preparation process. In this process it is possible to use any toner resin, disregarding the melting characteristics of said resin.

The toner particles to be used in said third mode of operation of the present invention, may prepared in two steps:

(i) the substantially light insensitive silver salt (compound B) is incorporated in the toner particles by a melt kneading process or by "polymer suspension" as described above under the second mode of operation of the present invention and under the general description of the toner particles, (ii) the toner particles are swollen, but not disolved, in an organic solvent wherein the reducing agent (compound A) is dissolved.

The dissolved compound A diffuses into the swollen toner particles which comprise finally, after evaporating of the solvent, compound B as well as compound A.

Toner particles, for use according to the third mode of operation of the present invention, comprise between 0.5 and 15% w/w of compound A (a reductant) and between 5 and 20% w/w of compound B (a substantially light insensitive silver salt).

EXAMPLES

EXAMPLE 1: The first mode of operation i. Preparation of toner particles comprising a reductant (compound A)

80 parts by weight of a linear polyester resin produced by the polycondensation of terephthalic acid, polyoxypropylene(2,3) 2,2 bis-4-hydroxyphenylpropane and ethylene glycol available under tradename DIACRON FC150 of Mitsubish Rayon, Japan, 10 parts by weight of $Al_2O_3C$ (ALUMINIUMOXIDE C, a tradename of Degussa AG, Frankfurt, Germany for hydrophilic aluminiumoxide with BET surface of 100 $m^2/g$) and 10 parts by weight of ethylgallate were intimately mixed together, placed in a melt kneader and heated to 120° C. to form a smelt. This smelt was mel kneaded for 20 minutes. Thereafter the mixture was allowed to cool to romm temperature (20° C.). At that temperature the mass was crushed and classified to give toner particles with average particle size of 8.5 μm based on volume.

ii. Preparation of a final substrate

A coating solution in methylethylketone was prepared comprising 47% by weight of silverbehenate, 47% by weight of BUTVAR B79 (tradename for polyvinylbutyral of Monsanto Company USA), 5.4% by weight of

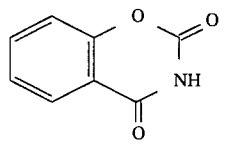

as toning agent and 0.6% by weight of BAYSILON OIL A (tradename of BAYER AG, Leverkusen, Germany for a silicone oil).

This coating solution was applied to a subbed transparent polyester support of 100 μm thick, such as to give a coating containing 6.5 g of silverbehenate per $m^2$.

iii. Image formation

The toner particles were used in a developer composition with a coated ferrite carrier (Ni-Zn type), with a magnetisation of 50 EMU/g. The average carrier particle diameter was about 65 micron. After addition of the toner particles to the carrier in an amount of 2,5% by weight with respect to the carrier, the developer was activated by rolling in a metal box with a diameter of 6 cm, at 300 revolutions per minute, during a period of 30 minutes, with an apparent degree of filling of 30%.

iv. Evaluation of the maximum density

The developer composition was used to develop an image of a step wedge. The image of such a wedge was projected on an electrophotographic recording element (i.e. an $As_2Se_3$ coated conductive drum, which was positively charged) by a high-quality optical device.

The electrostatically deposited toner was transferred by applying a positive voltage of 3 kV to a metal roll, which was kept in close ohmic contact with the rear side of the final substrate acting as receiving material whose front side (coated with a silverbehenate containing coating) was therefore kept in close contact with the toner image on the photoconductor.

The final substrate with image-wise transferred toner particles was fed to a radiation fusing device operating with a fusing oven at 120° C.

The optical maximum density and minimum density were measured, behind a UV-filter with a Macbeth TR-1224 optical densitometer.

The results are found in table 1.

TABLE 1

| | |
|---|---|
| Minimum density | 0.12 |
| Maximum density | 3.81 |

EXAMPLE 2: The second mode of operation i. Preparation of toner particles comprising a silverbehenate (compound B) and further comprising a pigment 80 parts by weight of a linear polyester resin produced by the polycondensation of terephthalic acid, polyoxypropylene(2,3) 2,2 bis-4-hydroxyphenylpropane and ethylene glycol available under tradename DIACRON FC150 of Mitsubish Rayon, Japan, 15 parts by weight of silverbehenate and 5 parts by weight of carbon black (CABOT REGAL 400, trade name of Cabot Corp. Boston Mass. USA) were intimately mixed together, placed in a melt kneader and heated to 120° C. to form a smelt. This smelt was mel kneaded for 30 minutes. Thereafter the mixture was allowed to cool to romm temperature (20° C.). At that temperature the mass was crushed and classified to give toner particles with average particle size of 8.0 μm based on volume. When deposited on a non reactive substrate (i.e. a substrate NOT comprising a reductant (compound A)) in a normal amount of 6 $g/m^2$ the toner particles gave, after fusing, a maximum density of 1.1 ii. Preparation of a final substrate

A coating solution in methylethylketone was prepared comprising 24% by weight of ethylgallate, 72% by weight of BUTVAR B79 (tradename for polyvinylbutyral of Monsanto company USA), 3.6% by weight of

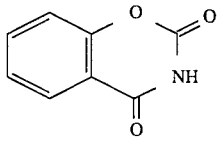

as toning agent and 0.4% by weight of BAYSILON OIL A (tradename of BAYER AG, Leverkusen, Germany for a silicone oil).

This coating solution was applied to a subbed transparent polyester support of 100 μm thick, such as to give a coating containing 2.0 g of ethylgallate per-$m^2$.

iii. Image formation

The toner particles were used in a developer composition with a coated ferrite carrier (Ni-Zn type), with a magnetisation of 50 EMU/g. The average carrier particle diameter was about 65 micron. After addition of the toner particles to the carrier in an amount of 2,5% by weight with respect to the carrier, the developer was activated by rolling in a metal box with a diameter of 6 cm, at 300 revolutions per minute, during a period of 30 minutes, with an apparent degree of filling of 30%.

iv. Evaluation of the maximum density

The developer composition was used to develop an image of a step wedge. The image of such a wedge was projected on an electrophotographic recording element (i e an $As_2Se_3$ coated conductive drum, which was positively charged) by a high-quality optical device.

The electrostatically deposited toner was transferred by applying a positive voltage of 3 kV to a metal roll, which was kept in close ohmic contact with the rear side of the final substrate acting as receiving material whose front side (coated with an ethylgallate containing coating) was therefore kept in close contact with the toner image on the photoconductor.

The final substrate with image-wise transferred toner particles was fed to fusing device operating with a fusing oven at 120° C.

The optical maximum density and minimum density were measured, behind a Ortho-filter with a Macbeth TR-1224 optical densitometer.

The results are found in table 2.

TABLE 2

| | |
|---|---|
| Minimum density | 0.06 |
| Maximum density | 2.30 |

We claim:

1. An electro(stato)graphic method comprising the steps of image wise applying toner particles to a final non-photoconductive substrate and fixing said toner particles on said final substrate, wherein (i) said toner particles comprise at least one reductant (compound A) and said final substrate comprises at least one substantially light insensitive silver salt (compound B) or vice versa, so as to be capable, upon reaction of compound A and B, of forming a light absorbing substance in said final substrate, (ii) said toner particles optionally comprise a light absorbing pigment or dye, (iii) said light absorbing substance can give a maximum density ($D_{max}$)>2.00 either on itself or in combination with said light absorbing pigment or dye and (iv) said toner particles are fixed on to the final substrate by heat or by heat and pressure.

2. An electro(stato)graphic method according to claim 1, wherein said final substrate is transparent.

3. An electro(stato)graphic method according to claim 1, wherein either said toner particles or said final substrate, or both, further comprise an auxiliary reductant (compound C).

4. An electrostatographic method according to claim 1, wherein said substantially light insensitive silver salt is a silver salt of an aliphatic fatty acid having an aliphatic carbon chain with at least 12 C-atoms.

5. An electros(stato)graphic method according to claim 1, wherein said reductant is a di- or trihydroxy compound.

6. An electro(stato)graphic method according to claim 4, wherein said substantially light insensitive silver salt (compound B) is silverbehenate.

7. An electro(stato)graphic method according to claim 5, wherein said reductant (compound A) is gallic acid or a derivative thereof.

8. An electro(stato)graphic method according to claim 3, wherein said auxilliarly reductant (compound C) is a sterically hindered phenol.

9. An electro(stato)graphic method according to claim 1, wherein either in said toner particles or in said final substrate, or in both a toning agent is present.

10. An electro(stato)graphic method according to claim 9, wherein said toning agent is 3,4-dihydroxy-2,4-dioxo-1,3,2H-benzoxazine.

11. An electro(stato)graphic method according to claim 1, wherein said toner particles further comprise an IR absorbing pigment and/or an organic IR absorber.

12. An electrostatographic method according to claim 1, wherein said toner particles are fixed by IR-radiation.

13. An electro(stato)-graphic method comprising the steps of image wise applying toner particles to a final non-photoconductive substrate and fixing said toner particles on said final substrate, wherein (i) said toner particles comprise at least one substantially light insensitive silver salt (compound B) and at least one reductant (compound A), so as to be capable, upon reaction of compound A and B, of forming a light absorbing substance in said final substrate, (ii) said toner particles optionally comprise a light absorbing pigment or dye, (iii) said light absorbing substance can give a maximum density ($D_{max}$)>2.00 either on itself or in combination with said light absorbing pigment or dye and (iv) said toner particles are fixed on to the final substrate by heat or by heat and pressure.

14. An electro(stato)graphic method according to claim 13, wherein said final substrate is transparent.

15. An electro(stato)graphic method according to claim 13, wherein either said toner particles or said final substrate, or both, further comprise an auxiliary reductant (compound C).

16. An electrostatographic method according to claim 13, wherein said substantially light insensitive silver salt is a silver salt of an aliphatic fatty acid having an aliphatic carbon chain with at least 12 C-atoms.

17. An electros(stato)graphic method according to claim 13, wherein said reductant is a di- or trihydroxy compound.

18. An electro(stato)graphic method according to claim 16, wherein said substantially light insensitive silver salt (compound B) is silverbehenate.

19. An electro(stato)graphic method according to claim 17, wherein said reductant (compound A) is gallic acid or a derivative thereof.

20. An electro(stato)graphic method according to claim 15, wherein said auxilliarly reductant (compound C) is a sterically hindered phenol.

21. An electro(stato)graphic method according to claim 13, wherein either in said toner particles or in said final substrate, or in both a toning agent is present.

22. An electro(stato)graphic method according to claim 21, wherein said toning agent is 3,4-dihydroxy-2,4-dioxo-1,3,2H-benzoxazine.

23. An electro(stato)graphic method according to claim 13, wherein said toner particles further comprise an IR absorbing pigment and/or an organic IR absorber.

24. An electrostatographic method according to claim 13, wherein said toner particles are fixed by IR-radiation.

* * * * *